US006125941A

United States Patent [19]

Lokken

[11] Patent Number: 6,125,941

[45] Date of Patent: Oct. 3, 2000

[54] FIRE BLANKET

[75] Inventor: Oddvin Lokken, Rye, N.Y.

[73] Assignee: Life Tech Systems Inc., Fairfax, Va.

[21] Appl. No.: 08/968,998

[22] Filed: Nov. 12, 1997

[51] Int. Cl.[7] ..... A62C 8/00

[52] U.S. Cl. ..... 169/50; 169/48

[58] Field of Search ..... 169/43–48, 49, 169/50, 54; 52/168

[56] References Cited

U.S. PATENT DOCUMENTS

| | | | |
|---|---|---|---|
| 2,560,269 | 7/1951 | Berner | 169/2 |
| 3,724,555 | 4/1973 | Chiasson et al. | 169/2 |
| 3,902,559 | 9/1975 | Everingham et al. | 169/50 |
| 3,935,099 | 1/1976 | Weaver et al. | 210/43 |
| 3,960,216 | 6/1976 | Isobe | 169/48 |
| 4,433,733 | 2/1984 | Cunningham | 169/49 |
| 4,597,450 | 7/1986 | Budmiger | 169/50 |
| 4,665,993 | 5/1987 | Balassa | 169/44 |
| 4,811,793 | 3/1989 | Lokken | 169/48 |
| 4,956,218 | 9/1990 | Haining | 428/102 |
| 5,146,996 | 9/1992 | Gainer | 169/49 |
| 5,188,186 | 2/1993 | Nash | 169/48 |
| 5,423,150 | 6/1995 | Hitchcock | 52/1 |
| 5,481,834 | 1/1996 | Kowalczyk et al. | 52/64 |

*Primary Examiner*—Andres Kashnikow
*Assistant Examiner*—Jorge Bocanegra
*Attorney, Agent, or Firm*—Graham & James LLP

[57] ABSTRACT

A blanket for smothering fires or protecting items from fire, comprised of a wettable polymer capable of high volume water retention, a water reservoir and heat activatable valves or water source to permit water to flow from the reservoir to wet the polymer through gravity fed conduits. For fire extinguishing, such as well-head fires, the blanket further comprises a heavy metal framework and an under-blanket support. The blanket is weighted and sized to cover the well-head fires with sufficient wetting to maintain it in place for sufficient time for smothering of the fire with an airtight closure. Uses of the reservoir-connected blanket include houses and mobile homes, protection suits and doorway mounts. In an embodiment used to protect valuable items, the polymer portion of the blanket is comprised of a tri-layer configuration of: a) a water tight liner to prevent water damage to the covered item, b) the wettable polymer, and c) a protective outer coat of a material such as glass fiber, kevlar and the like. If sufficiently stiffened, the polymer material can be utilized as a structural member in houses or boats with the water source being the river or other body of water the boat is set upon, or an existing sprinkler system in a house.

5 Claims, 10 Drawing Sheets

FIRE BLANKET

FIELD OF THE INVENTION

This invention relates to fire blankets used for either smothering fires or for protecting valuable items from fires for extended periods of time.

BACKGROUND OF THE INVENTION

Fire blankets have been utilized for putting out fires or for protection of valuable items. However, the fireproof asbestos of which such blankets were made is ecologically harmful in its own right and is no longer utilized. Blankets of other fireproof materials are either exceedingly expensive or do not maintain their fireproof capability for the extended periods of time necessary for smothering difficult to control fires such as oil well-head fires. In addition, lightweight fire blankets either do not provide a proper air-tight seal for an effective use or are susceptible to being blown off by the hot air currents generated by fuel fed fires such as well-head fires.

Blankets which have been wetted, while effective in many applications, are however not useful for long term protective use since the contained water is subject to evaporation over periods of time or is insufficient because of the limited absorption afforded by the blanket materials.

SUMMARY OF THE INVENTION

It is accordingly an object of the present invention to provide a highly water retentive polymer material and water source for use in smothering fires or protecting people or property.

It is a further object of the present invention to provide the polymer material with means for maintaining it in a protective or flame smothering position.

It is yet another object of the present invention to use the water retaining polymer of the present invention with a water reservoir source and heat activatable means for causing the water to wet the polymer when needed.

It is still yet another object of the present invention to utilize the water retaining polymer in applications including a blanket for covering houses to protect against proximate fires and to smother well-head fires, as well as in dormant insulation material in houses (e.g. roofing material) mobile homes, in boats, house doorways, and the like, and as a carpet liner to prevent fire spread through flooring.

These and other objects, features and advantages of the present invention will become evident from the following discussion and drawings in which:

SHORT DESCRIPTION OF THE DRAWINGS

Figure 2:
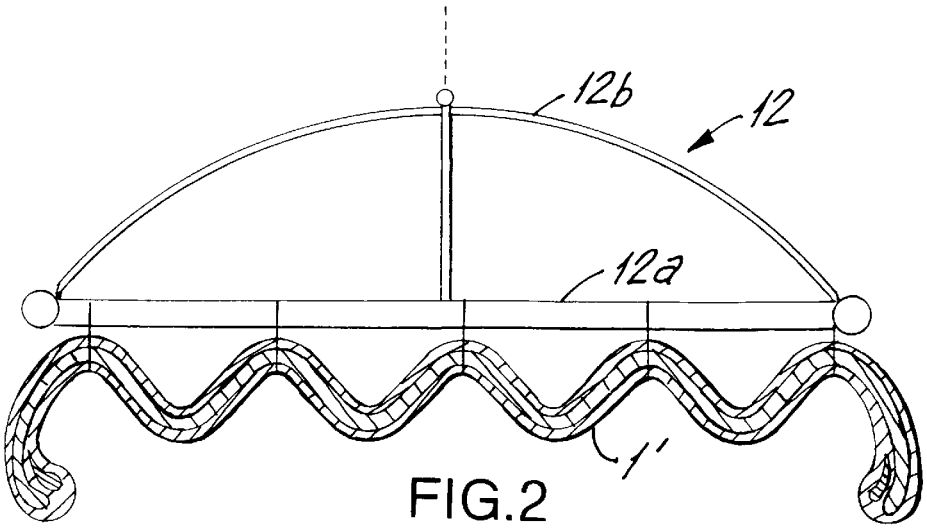
FIG. 2 is a side view of a polymer blanket of the present invention adapted for use in smothering wellhead fires.
Figure 3A:
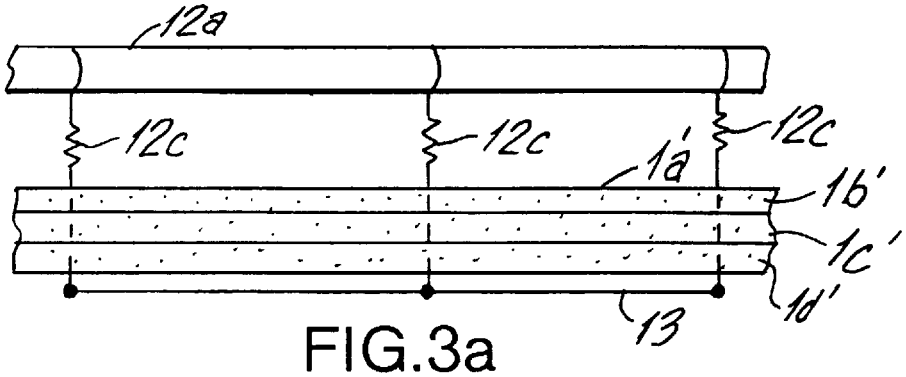
Figure 3B:
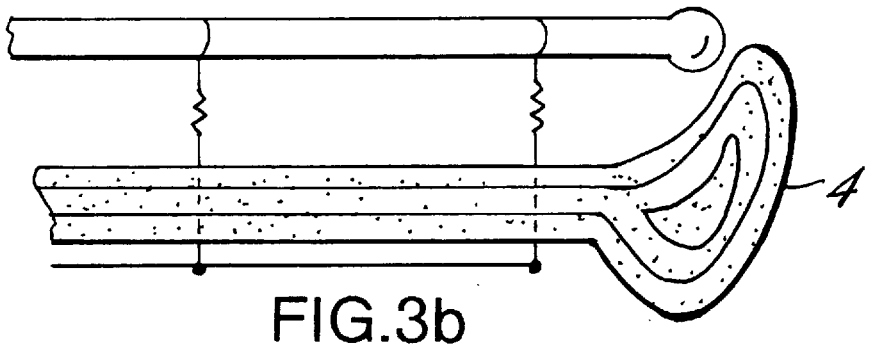
Figure 4A:
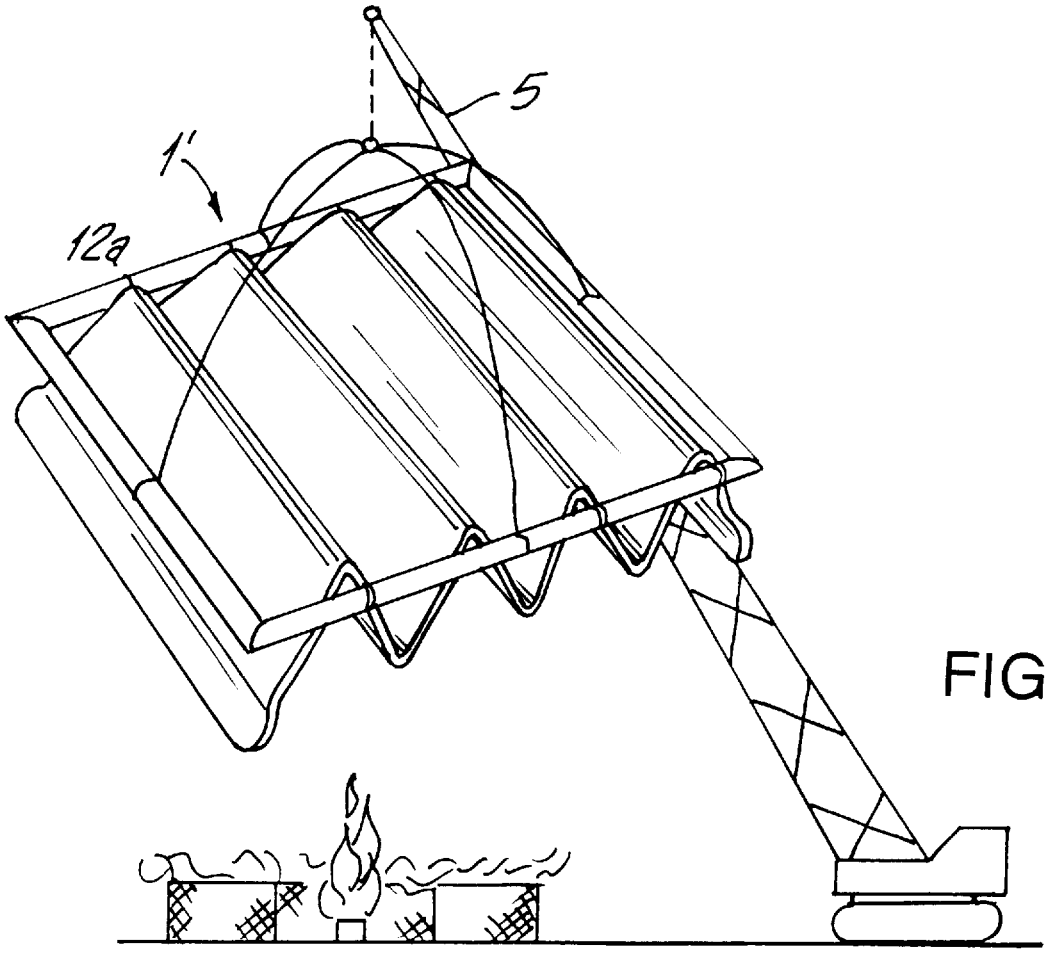
Figure 4B:
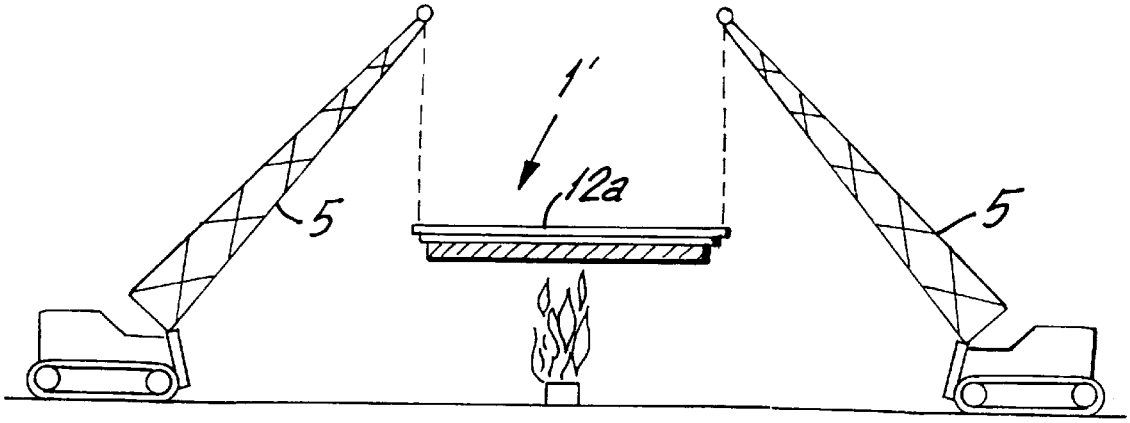
Figure 4C:
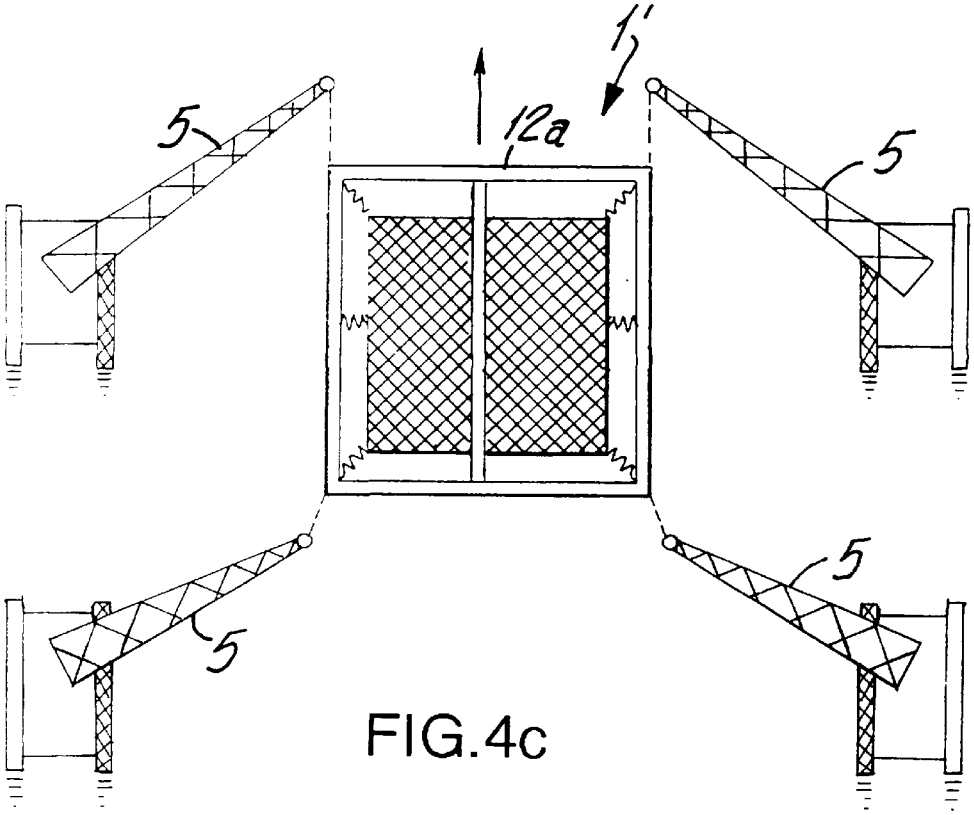
Figure 5A:
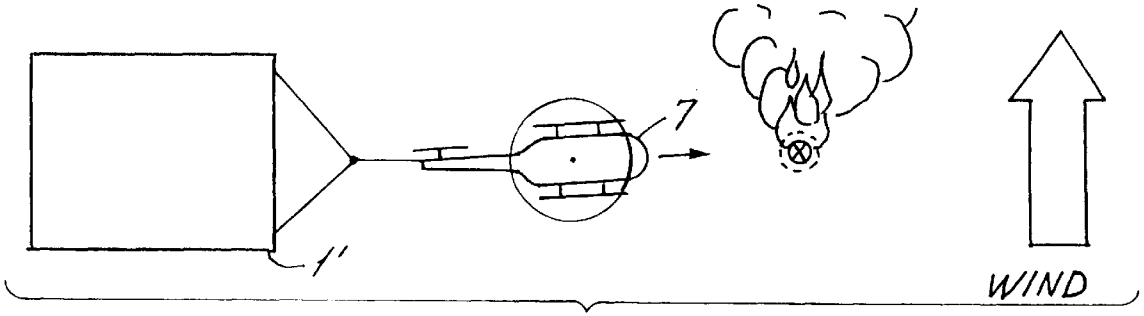
Figure 5B:
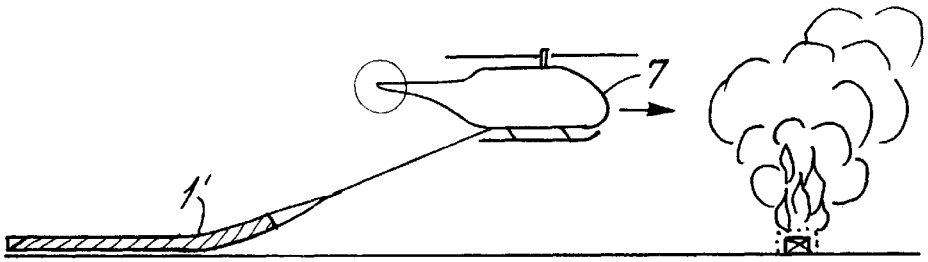
Figure 5C:
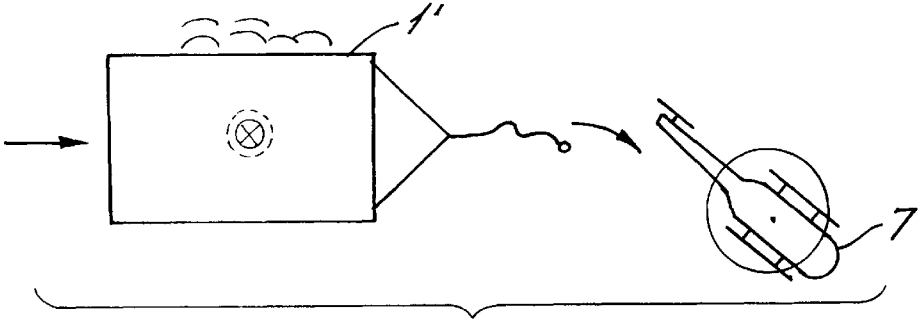
Figure 6:
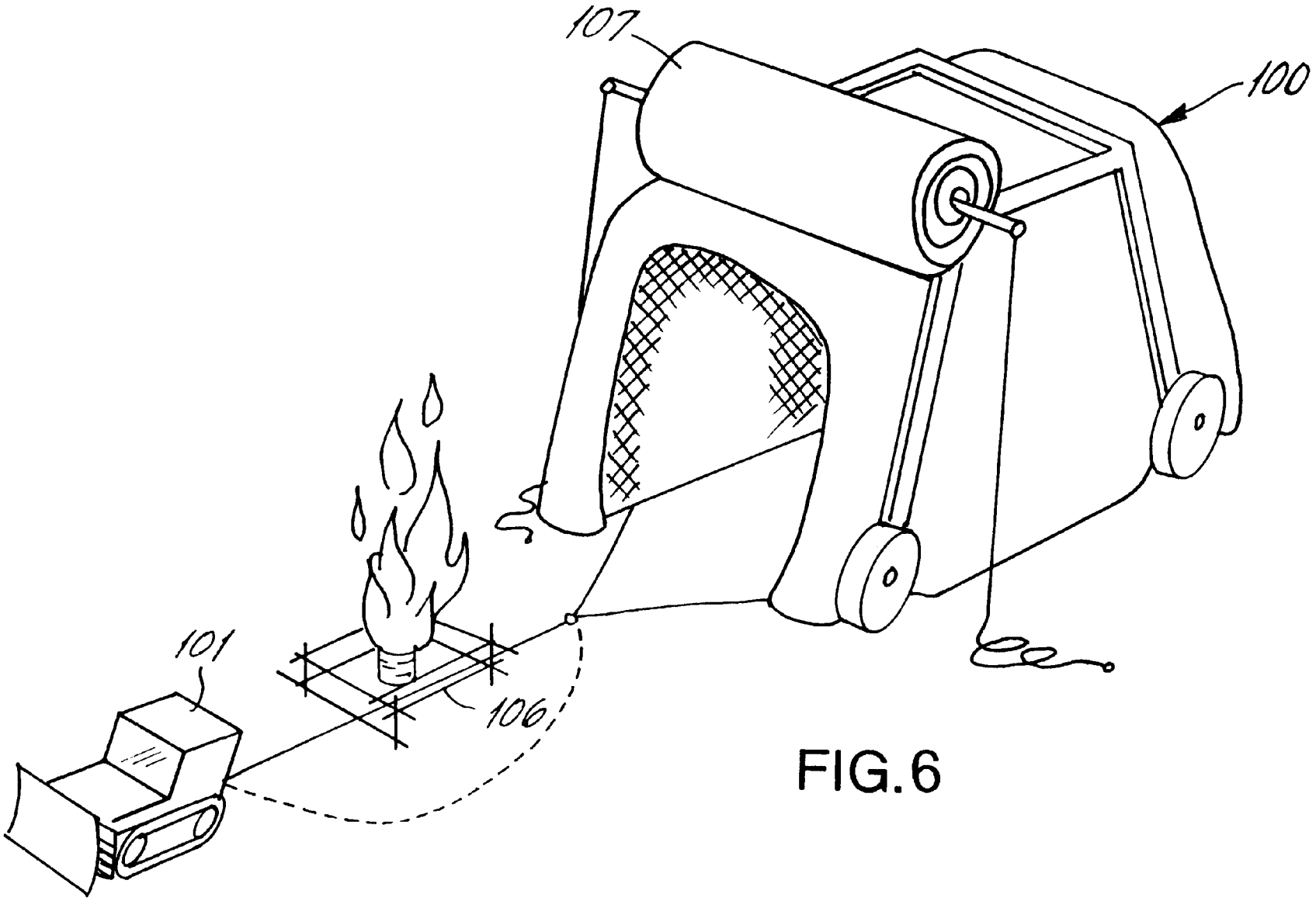
Figure 8:
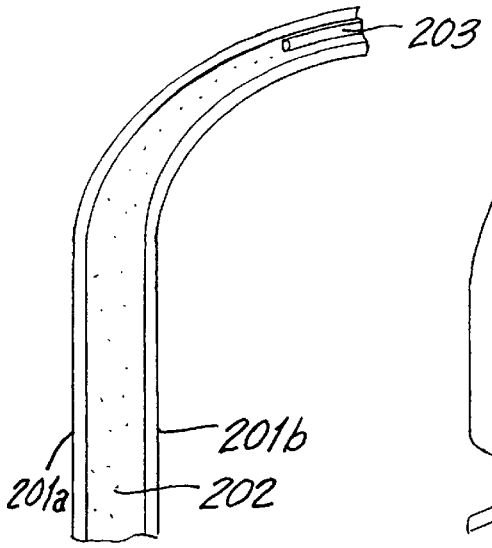
Figure 7:
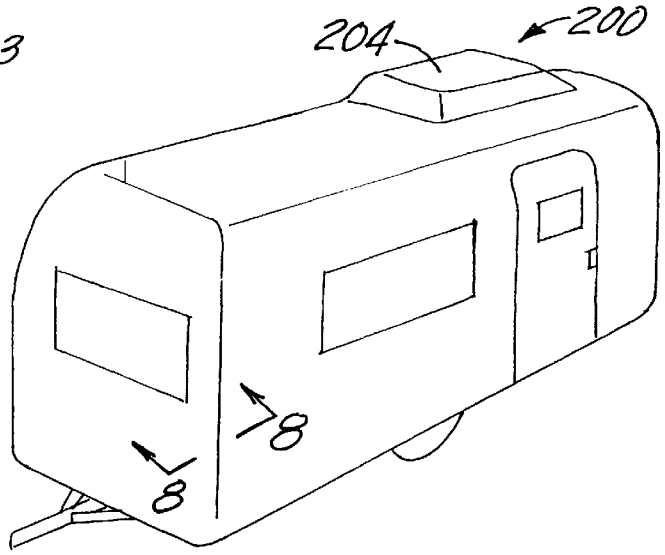
Figure 10:
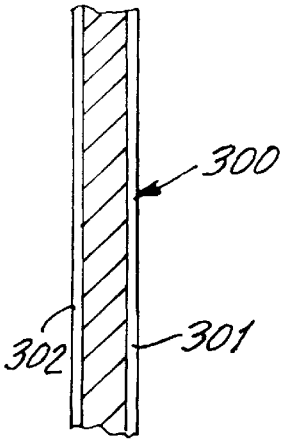
Figure 9:
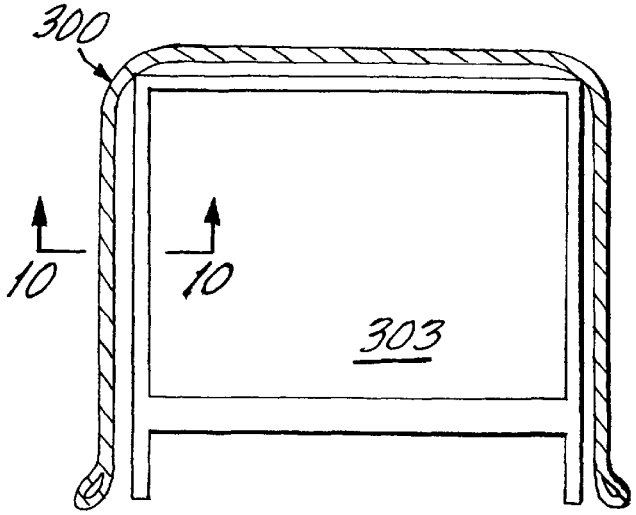
Figure 11A:
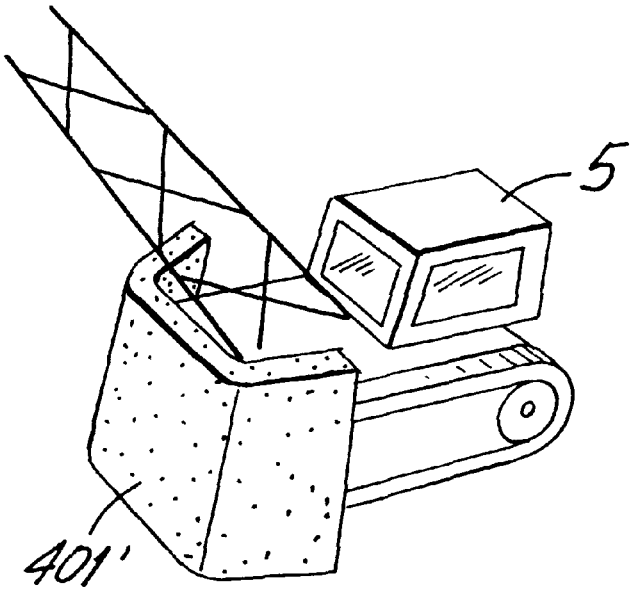
Figure 11B:
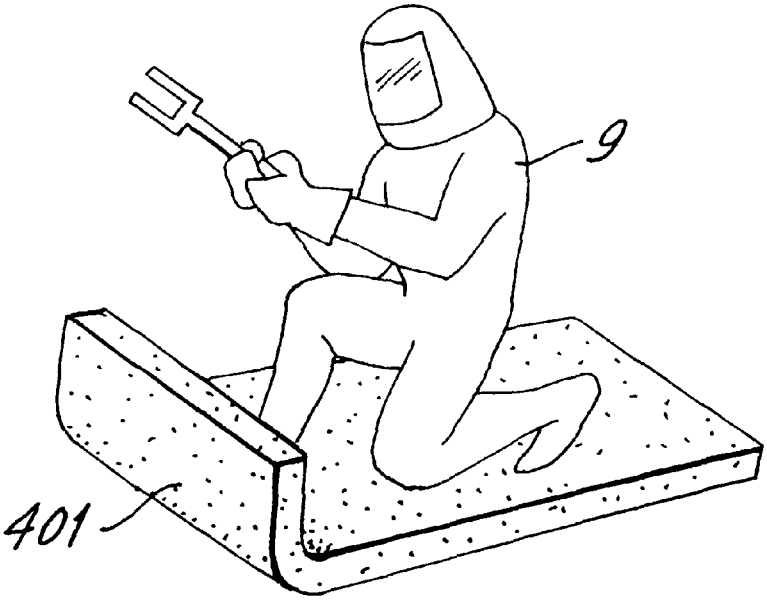
Figure 12:
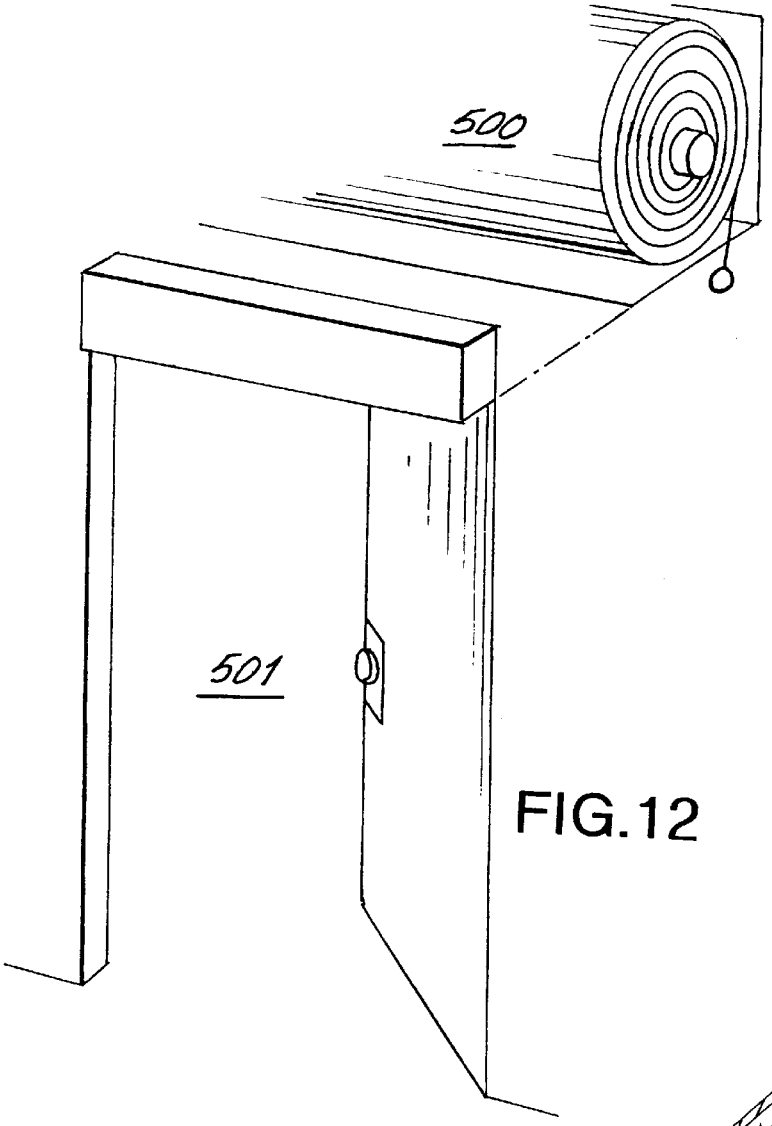
Figure 13:
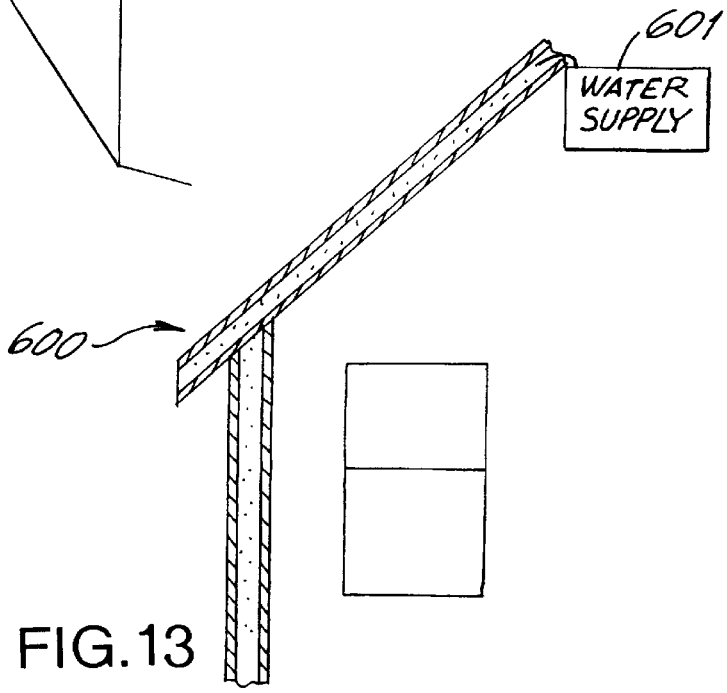
Figure 14:
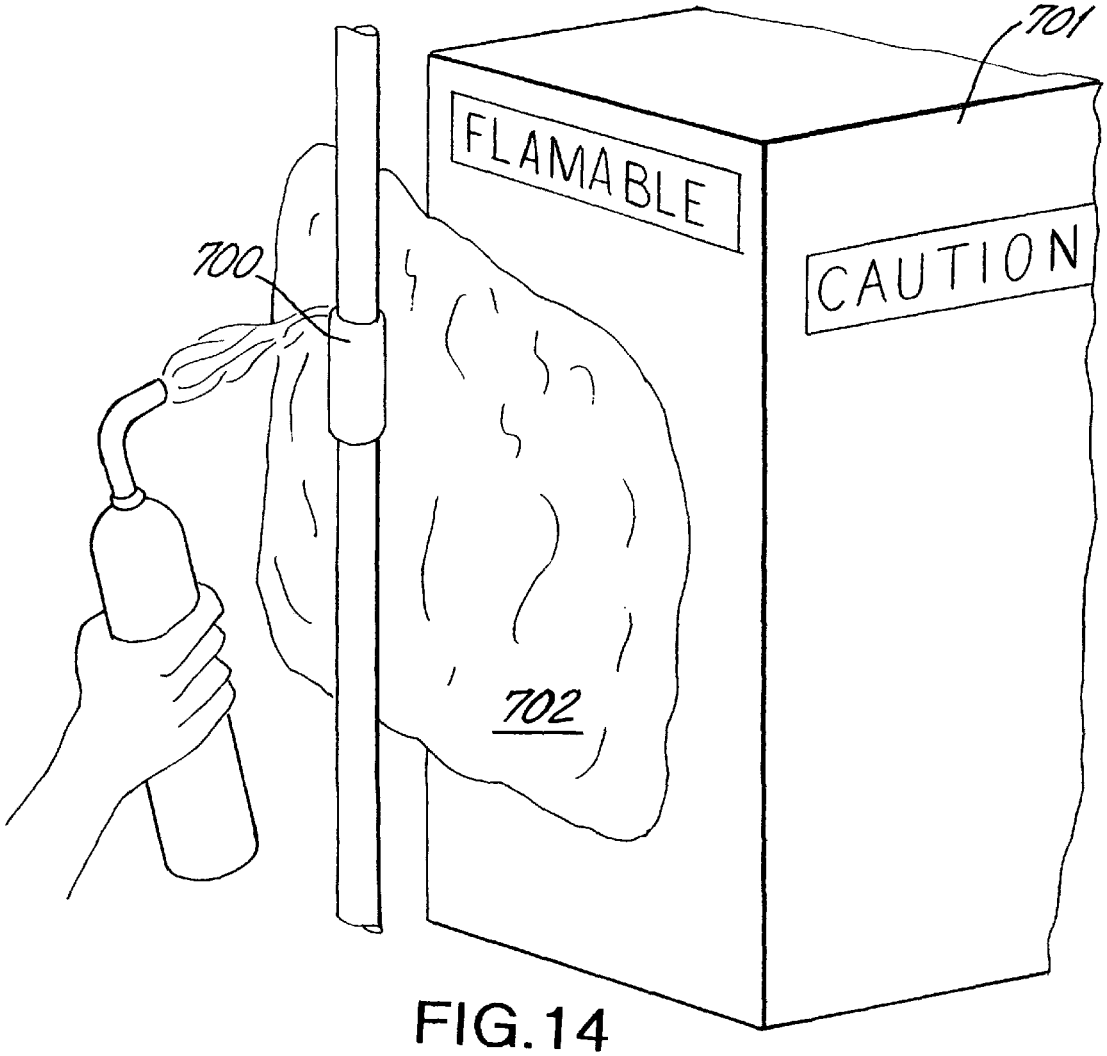
Figure 15:
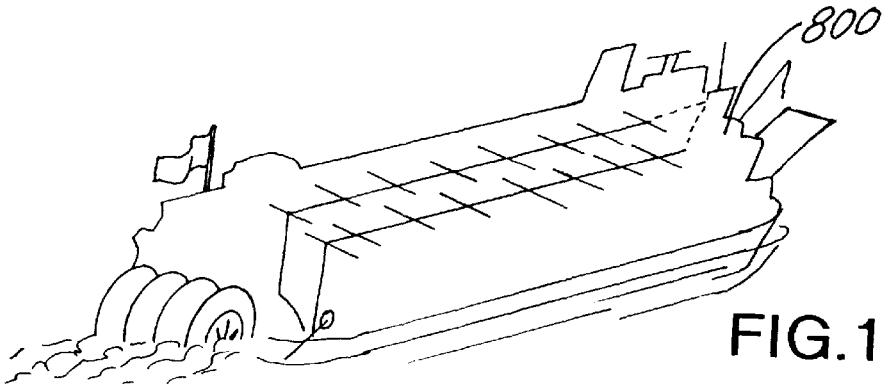
Figure 16:
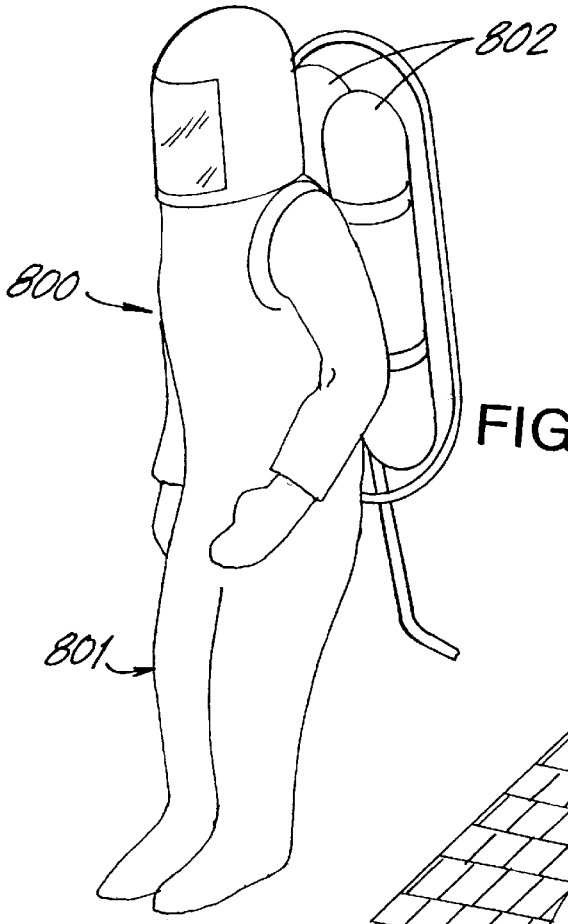
Figure 17:
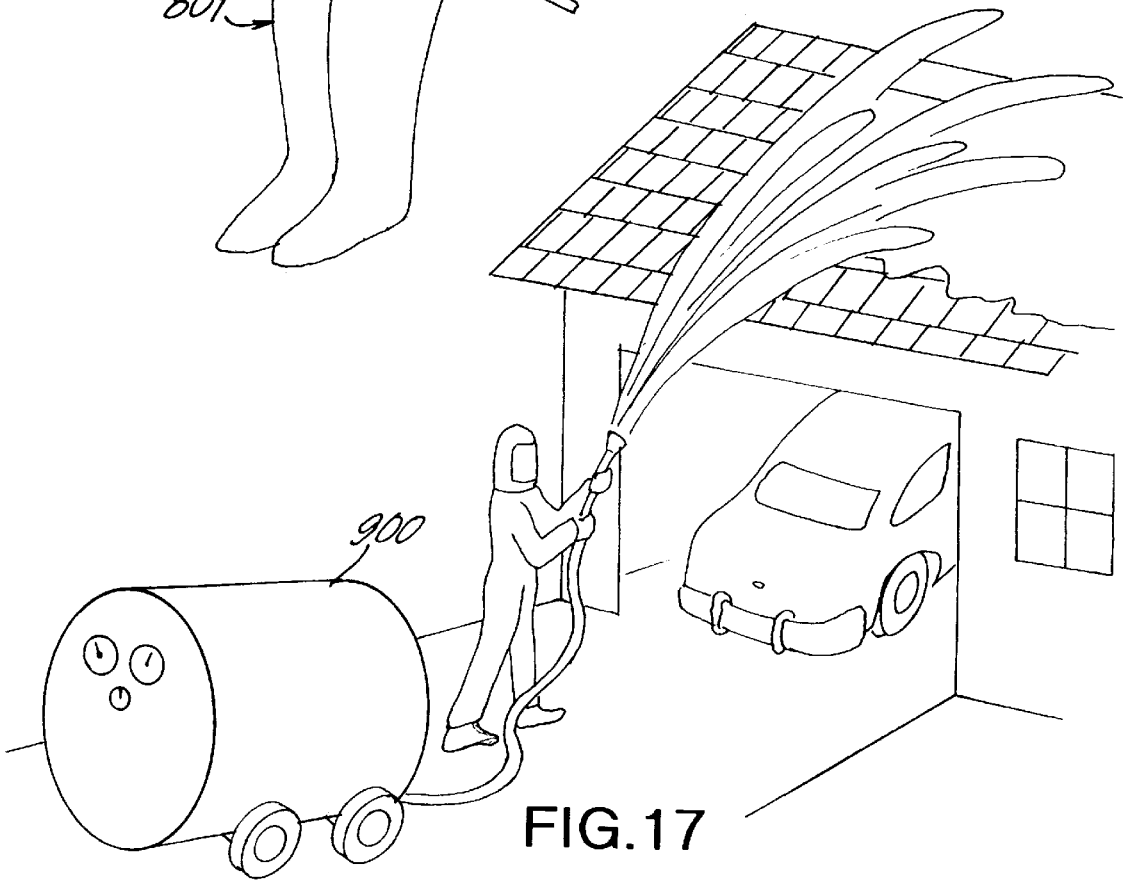

FIGS. 3*a* and 3*b* are section views of the blanket shown in FIG. 2, with details of the layer compositions and conforming end structure respectively;

FIGS. 4*a–c* sequentially depict use of one or more cranes to deploy and properly position the blanket structure of FIGS. 2 and 3*a–b* on an oil well fire;

FIGS. 5*a–c* sequentially depict deployment and positioning with a helicopter;

FIG. 6 is a movable enclosure structure constructed of the water retaining polymer, being positioned on a fire and thereafter sealed shut by unfurling with a rolled up cover;

FIG. 7 schematically depicts a mobile home with a double wall structure and a water supply reservoir;

FIG. 8 is a cross section view of the wall taken along line 8—8;

FIG. 9 is a protective water blanket shown protecting valuable equipment;

FIG. 10 is a cross section of the blanket of FIG. 9 taken along line 10—10;

FIGS. 11*a* and 11*b* show use of the blanket in protecting equipment and fire fighting personnel combatting a fire respectively;

FIG. 12 depicts a rolled blanket in stored position above a doorway;

FIG. 13 is a cross section view of a house with the walls being filled with the water retaining polymer of the present invention as insulation material;

FIG. 14 depicts use of the blanket of the present invention as a shield around a welding site;

FIG. 15 schematically depicts a river boat constructed with the polymer material of the present invention linked to a sprinkler system which is pump fed from the river as the water source;

FIG. 16 depicts use of the polymer material in constructing a fire retardant suit for use in fire fighting and rescue work; and FIG. 17 depicts in situ formation of the polymer blanket on a structure for protective purposes;

DETAILED DESCRIPTION OF THE INVENTION

Generally the present invention comprises a blanket (preformed or formed in situ) or structural member formed from a blanket material, for smothering fires or protecting items from fire. The blanket is comprised of a base material which contains or supports a wettable polymer capable of rapid high volume water absorption and retention, a water reservoir and heat activatable valves to permit water to flow from the reservoir to wet the polymer through gravity fed conduits. Alternatively the heat sensing and activatable valves are connected to a sprinkler system, a water pump, or the like for activation upon the sensing of an elevated heat condition, with resultant water being forced to the polymer. For fire extinguishing purposes, such as for use with well-head fires, the blanket further comprises a heavy metal framework and an under-blanket support. The blanket is weighted and sized to cover the well-head fires with sufficient wetting to maintain it in place for sufficient time for smothering of the fire with an airtight closure. The blanket material is however sufficiently porous to permit steam (from highly heated water) to escape when necessary. Uses of the reservoir-connected blanket include houses and mobile homes, protection suits and doorway mounts. In an embodiment used to protect valuable items, the polymer portion of the blanket is comprised of a tri-layer configuration of: a) a water tight liner to prevent water damage to the covered item, b) the wettable polymer, and c) a protective outer coat of a material such as glass fiber, kevlar and the like. If sufficiently stiffened, the polymer material can be utilized as a structural member in houses or boats with the water source being the river or other body of water the boat is set upon, or an existing sprinkler system in a house.

Water absorbent polymers useful in the present invention are any of the polymers disclosed in U.S. Pat. Nos. 3,669, 103; 3,670,731; and 3,935,099. Other super-absorbent polymers are known, such as are used in sanitary products and diapers and are commonly referred to as "Super-Slurper" materials. As an example, commercially available starch-graft copolymers containing gelatinized starch and saponified polyacrylonitrile under U.S. Pat. No. 3,935,099 can absorb at least 40 times and as much as 1000 times (or more) their weight in water and most often in the range of about 500–600 times their weight. The polymer materials may be formed in any manner as known in the art such as by adhesively securing particles, fibers or films of the desired polymer and placed on a substrate such as in the form of a mesh or net within the blanket material.

DESCRIPTION OF THE PREFERRED EMBODIMENTS AND THE DRAWINGS

Figure 1:
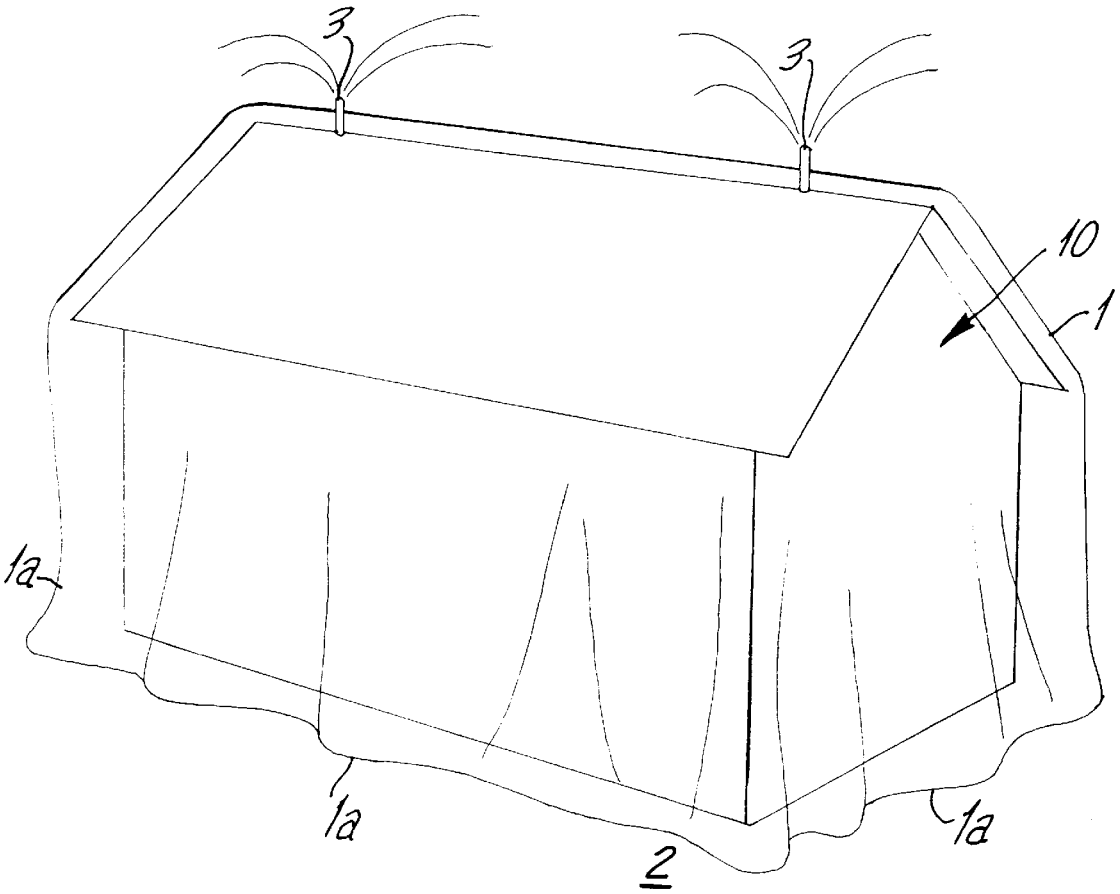
FIG. 1 is a schematic view of a blanket made in accordance with the present invention being used to cover and protect a house against a proximate fire and sparks by means of a hookup with a sprinkler system water supply source.

With reference to the drawings, in FIG. 1, a house 10 is entirely covered by an absorbent polymer containing blanket 1, with the edges of the blankets la resting on the ground 2, to effectively form a fire protective shroud with proximate flames and sparks being effectively prevented from igniting the shrouded area. Sprinklers 3 on the roof of the house 10 extend through the blanket and provide water to the absorbent polymer of the blanket, whereby the blanket is kept cool and protected from damage from the flames, until the danger condition is alleviated.

In FIGS. 2 and 3*a–b,* in an embodiment used for smothering well-head oil fires, polymer blanket 1' is provided with a weighted framework 12 for facilitating deployment of the blanket. The framework 12 comprises heavy metal frame 12*a* to which the blanket is loosely affixed. An arced hanger section 12*b* attached to the ends of cross-piece 12*a* permits manipulative movement and placement by cranes, as shown in FIGS. 4*a–c* (1, 2 and 4 cranes respectively) or helicopters as shown in FIGS. 5*a–c.* As shown in detailed cross-section in FIGS. 3*a* and 3*b,* the blanket 1' is affixed to the framework by means of suspension wires 12*c* which pass through the blanket layers 1*a'–d'* (as shown) of fiberglass with contained polymers, into engagement with flexible under blanket support frame 13. The peripheral edges 4 of the blanket layers are united and formed to topographically conform to a support area.

As shown in FIGS. 4*a–c* the blanket 1' is placed by remote manipulation of one, two or four cranes 5 over well-head fire 6, by symmetrical support of the cranes at various points of the frame 12*a.* Alternatively, the blanket without the framework of FIGS. 4*a–c,* is towed by a helicopter 7, as shown in FIGS. 5*a–c* and deployed in accordance with wind direction (crosswind shown in FIG. 5*a,* upwind shown in FIG. 5*c* and with a tow drag shown in FIG. 5*b*).

The blanket 100 is formed into an enclosure on wheels in FIG. 6, which is directly towed along the ground by heavy machinery such as the bull-dozer 101 into placement above the well-head fire 106 and then furled front cover 107 is dropped to form a smothering complete enclosure above the fire.

In the aforementioned embodiments shown in FIGS. 2–6, the blankets are wet with water directly prior to use. In the embodiment shown in FIG. 7 and in partial cross section in FIG. 8, the polymer "blanket" is used in a prophylactic mode for use in case of a fire. In the mobile home 200, the space between the double wall structure 201*a* and 201*b* of the mobile home is filled with the polymer 202 to effectively form an in situ "blanket". The polymer is provided with a duct 203 leading to a water supply reservoir 204 on top of the mobile home whereby heat or smoke activated valves open to permit a gravity feed of water to the polymer, only at a time when required, to retard fire propagation, reduce heat and contain smoke and fumes both into and out of the mobile home.

In a different mode of use shown in FIGS. 9 and 10, the polymer containing blanket 300 is provided with an inner water impermeable liner 301 and an outer protective layer 302 of glass fiber, kevlar and the like, whereby it is utilized to protect valuables or valuable equipment 303 from external ambient fire or smoke. Liner 301 prevents water from seeping into the valuables or equipment.

If the heat of an adjacent fire is intense, the blanket can be utilized as shown in FIGS. 11*a* and 11*b* to protect fire fighting equipment and personnel such as the crane 5 and firefighter 9 respectively by providing a heat deflecting shield between the fire and the equipment or personnel.

Doorway, hallway or stairwell protection is afforded as shown in FIG. 12 wherein a rolled up polymer containing blanket 500 is stored above doorway 501 and hooked into an existing water supply such as a water reservoir or building sprinkler system. Upon need for activation, i.e., unfurling to cover the doorway, the blanket is unfurled either manually or automatically and heat or smoke activated valves cause water to be supplied (preferably by gravity feed) to the deployed blanket for protection or containment of a fire. The application shown is useful in hallways, and public spaces, e.g. office buildings, hospitals, hotels and the like, to aid in containing a fire or fires. Carpeting 502 can similarly be provided with a liner containing the polymer of the present invention, hooked up to a sprinkler system in order to prevent spread of fire through flooring.

In a manner similar to that shown with the mobile home in FIGS. 7 and 8, as shown in FIG. 13, house 600 is provided with the polymer material as the insulation material in the walls and roof thereof. The polymer is however connected to a water supply 601, which is preferably in an elevated location such as on the roof to provide a gravity feed of water to the polymer.

The polymer blanket of the present invention can be utilized in conjunction with an open flame in order to prevent ignition of flammable materials. Thus, in FIG. 14, welding of a pipe 700 is effected without affecting a flammable material 701, which cannot be moved, by interposition of a small protective polymer blanket 702 between the weld site and the flammable material. Soldering can similarly be safely effected. Alternatively or in addition, the protective blanket can be used as an effective smothering blanket for small fires which may occur such as on stoves, marine engines, and the like.

Where water is readily available as in FIG. 15, in an embodiment of a riverboat 800, walls of the boat are provided with the polymeric material and water is pumped directly from the river to the polymer when needed for fire containment.

For firefighting or rescue personnel, the polymer blanket of the present invention is fashioned into a protective garment, i.e., the full body suit 800 as shown in FIG. 16 with, for structural strength, an outer surface 801 made from silicon treated glass. The suit 800, in such embodiment requires its own air supply in tanks 802 which are covered with the water retaining polymer material to keep the temperature thereof at tolerable levels.

FIG. 17 depicts rapid deployment and protection of property which may be threatened by fire. As shown, a portable compressor 900 with contained polymer and water is sprayed onto the property to be protected (the roof of a house is shown in FIG. 17) with a protective blanket being formed in situ thereby.

It is understood that the above embodiments and description are only illustrative of the present invention and that changes in structure, materials and modes of utilization are possible without departing from the scope of the present invention.

What is claimed is:

1. A fire protective blanket comprising a highly water absorbent polymer material supported on flexible blanket support means and means for providing sufficient water to the polymer to effect fire protection, wherein the blanket support means comprises a first layer of a water impervious material and a second layer of a flexible fire resistant material, wherein the polymer is contained between said first and second layer, with the first layer adapted to be adjacent an to be protected and the second layer adapted to face an external fire.

2. A fire protection layer comprising a highly water absorbent polymer material supported within spaced walls of a structure and means for providing sufficient water to the polymer to effect fire protection under elevated heat conditions, wherein the structure comprises a protective enclosing suit for a human.

3. A fire protection layer comprising a highly water absorbent polymer materials supported within spaced walls of a structure wherein the structure comprises a protective enclosing suit for a human and further comprising a means for supplying air to the protective enclosing suit.

4. The fire protection layer of claim 3 wherein the polymer can absorb at least 40 times its weight in water.

5. The fire protection layer of claim 3, wherein the polymer is comprised of a starch graft copolymer.

* * * * *